US007404706B2

(12) United States Patent
Ishikawa et al.

(10) Patent No.: US 7,404,706 B2
(45) Date of Patent: Jul. 29, 2008

(54) SCROLL FLUID MACHINE HAVING OIL-SUPPLY HOLES BEING FORMED THROUGH A REINFORCEMENT BEARING PLATE ON A REAR SURFACE OF THE ORBITING SCROLL

(75) Inventors: Hidetoshi Ishikawa, Ebina (JP); Masaru Tsuchiya, Yokohama (JP)

(73) Assignee: Anest Iwata Corporation, Yokohama-shi, Kanagawa (JP)

( * ) Notice: Subject to any disclaimer, the term of this patent is extended or adjusted under 35 U.S.C. 154(b) by 37 days.

(21) Appl. No.: 11/593,997

(22) Filed: Nov. 7, 2006

(65) Prior Publication Data

US 2007/0104602 A1 May 10, 2007

(30) Foreign Application Priority Data

Nov. 8, 2005 (JP) ..... 2005-324114

(51) Int. Cl.
*F03C 2/00* (2006.01)
*F04C 18/00* (2006.01)

(52) U.S. Cl. ..... 418/55.3; 418/55.1; 418/55.2; 418/98

(58) Field of Classification Search ..... 418/55.1–55.6, 418/57, 91, 92, 98, 99; 464/102
See application file for complete search history.

(56) References Cited

U.S. PATENT DOCUMENTS

| | | | | |
|---|---|---|---|---|
| 5,823,756 | A * | 10/1998 | Kawazoe | 418/55.4 |
| 2005/0058564 | A1 * | 3/2005 | Satoh et al. | 418/55.1 |
| 2005/0220649 | A1 * | 10/2005 | Sato | 418/55.3 |
| 2007/0077159 | A1 * | 4/2007 | Tsuchiya et al. | 418/55.1 |

FOREIGN PATENT DOCUMENTS

| | | | |
|---|---|---|---|
| JP | 07-002961 | Y2 * | 1/1995 |
| JP | 7-42953 | B2 | 5/1995 |
| JP | 2004-308436 | A | 11/2004 |

* cited by examiner

*Primary Examiner*—Theresa Trieu
(74) *Attorney, Agent, or Firm*—Davis Bujold & Daniels, P.L.L.C.

(57) ABSTRACT

A scroll fluid machine comprises a fixed scroll, an orbiting scroll and a plurality of self-rotation preventing device for preventing the orbiting scroll from rotating on its own axis. On the rear surface of the orbiting scroll, a reinforcement bearing plate is fixed with a central bolt and an outer circumferential bolt. A follower of the self-rotation preventing device is provided in the reinforcement bearing plate. An oil-supply hole is formed through the reinforcement bearing plate to supply oil to the follower.

5 Claims, 4 Drawing Sheets

SCROLL FLUID MACHINE HAVING OIL-SUPPLY HOLES BEING FORMED THROUGH A REINFORCEMENT BEARING PLATE ON A REAR SURFACE OF THE ORBITING SCROLL

This application claims priority from Japanese Application Serial No. 2005-324114 filed Nov. 8, 2005.

BACKGROUND OF THE INVENTION

The present invention relates to a scroll fluid machine and particularly to a scroll fluid machine in which a fixed wrap of a fixed scroll in a housing engages with an orbiting wrap of an orbiting scroll rotatably mounted around an eccentric axial portion of a driving shaft, the orbiting scroll being eccentrically revolved with the driving shaft so that a gas sucked from the circumference or center of the housing is compressed or expanded towards the center or circumference.

JP2004-308436A discloses a scroll fluid machine having an orbiting scroll comprising an orbiting end plate having an orbiting wrap on each surface, and JP7-42953B2 discloses a scroll fluid machine in which an orbiting wrap projects on only one surface of an orbiting end plate.

In the former, during operation, a tip seal on the top of the fixed wrap of the fixed scroll slidably contacts each surface of the orbiting end plate under almost the same condition, so that almost the same pressure is applied to cause almost the same heat. Thus, each surface of the orbiting end plate is unlikely to stretch locally or be curved to prevent unsmoothing in operation or decrease in efficiency, or the tip seal of the fixed scroll is unlikely to wear unequally to prevent performance from decreasing or prevent vibration or noise.

However, as described in JP7-42953B2, in the orbiting scroll having the orbiting wrap only on one surface, a bearing boss projects on the rear surface of the orbiting end plate, so that the orbiting end plate is unequally deformed or stretched or causes angles of the orbiting wrap to differ locally owing to pressure load, friction with the tip seal of the fixed scroll or unequality on generated heat.

Thus, the orbiting wrap contacts the fixed end plate with deviation to cause variation in pressure locally reducing efficiency or involving noise, heat or vibration. Furthermore, the tip seals of the fixed and orbiting scrolls locally wears to decrease duration.

To prevent the orbiting end plate from deformation during operation, it is necessary to increase thickness of the orbiting end plate significantly. However, in the orbiting scroll, the orbiting end plate is manufactured integrally with the orbiting wrap by die casting from Al metal. With large thickness of the orbiting end plate, during cooling after die casting, cooling speed of the orbiting end plate and orbiting wrap becomes nonuniform, so that the angle of the orbiting wrap becomes different locally to decrease efficiency thereby speeding up wear or causing noise.

Furthermore, in the center of the rear surface of the orbiting end plate, an eccentric axial portion of the driving shaft is mounted via a ball bearing and a known pin-crank-type self-rotation preventing device is mounted at three positions equally spaced on the rear surface of the orbiting end plate. It is necessary to provide a supply hole for grease for each of the bearings horizontally, and it is troublesome for the grease to put in the bearing via the holes.

SUMMARY OF THE INVENTION

In view of the disadvantages in the prior art, it is an object of the invention to provide a scroll fluid machine in which an orbiting end plate is made as thin as possible to prevent an orbiting wrap from becoming nonuniform or being deformed locally owing to difference in cooling speed of each part after casting when made of Al metal by die casting and preventing the orbiting end plate from curving or being deformed locally owing to differences in heat and pressure strength during operation, oil being easily supplied into bearings.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
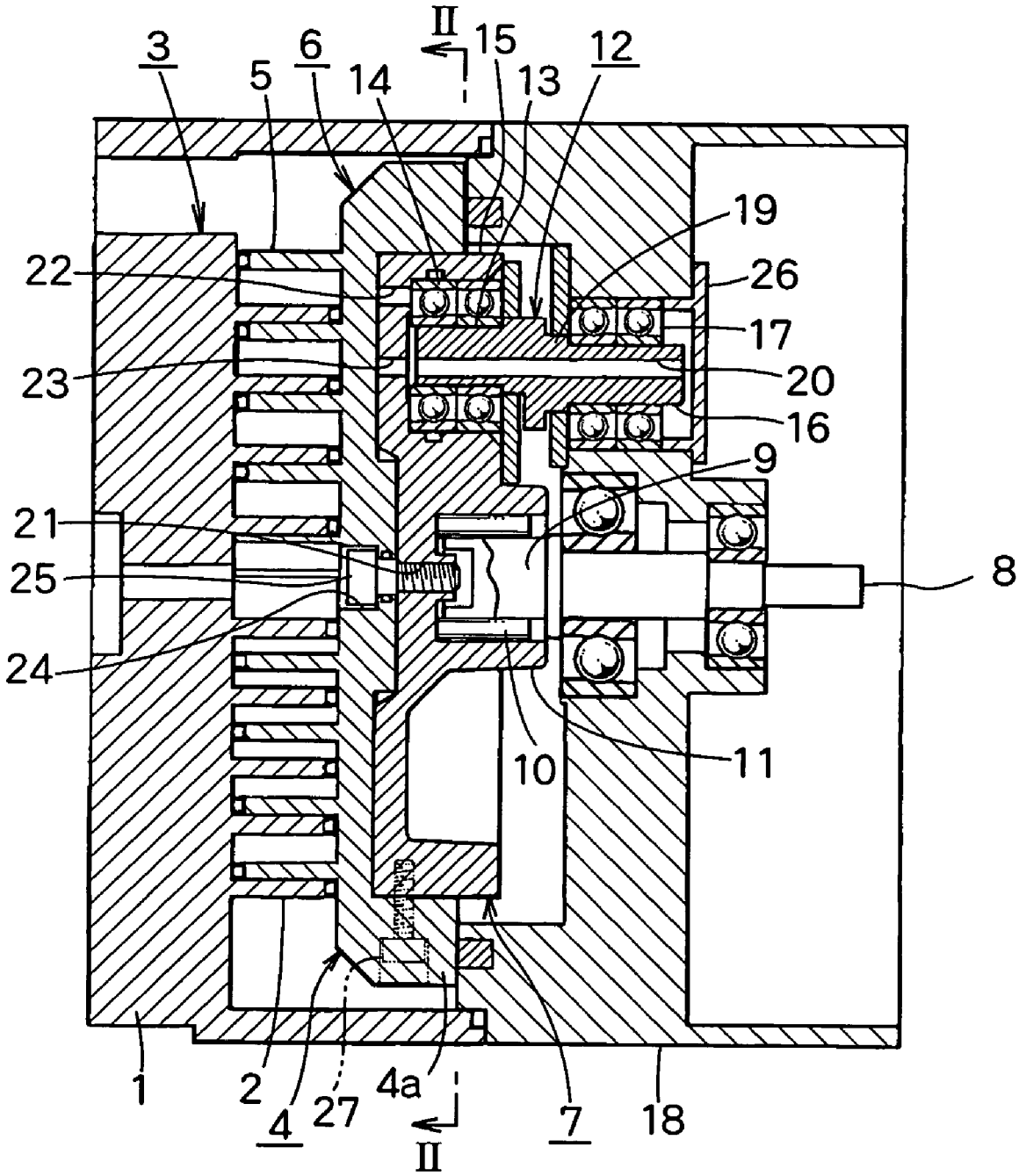
FIG. 1 is a vertical sectional side view of the first embodiment of a scroll fluid machine according to the present invention.
Figure 2:
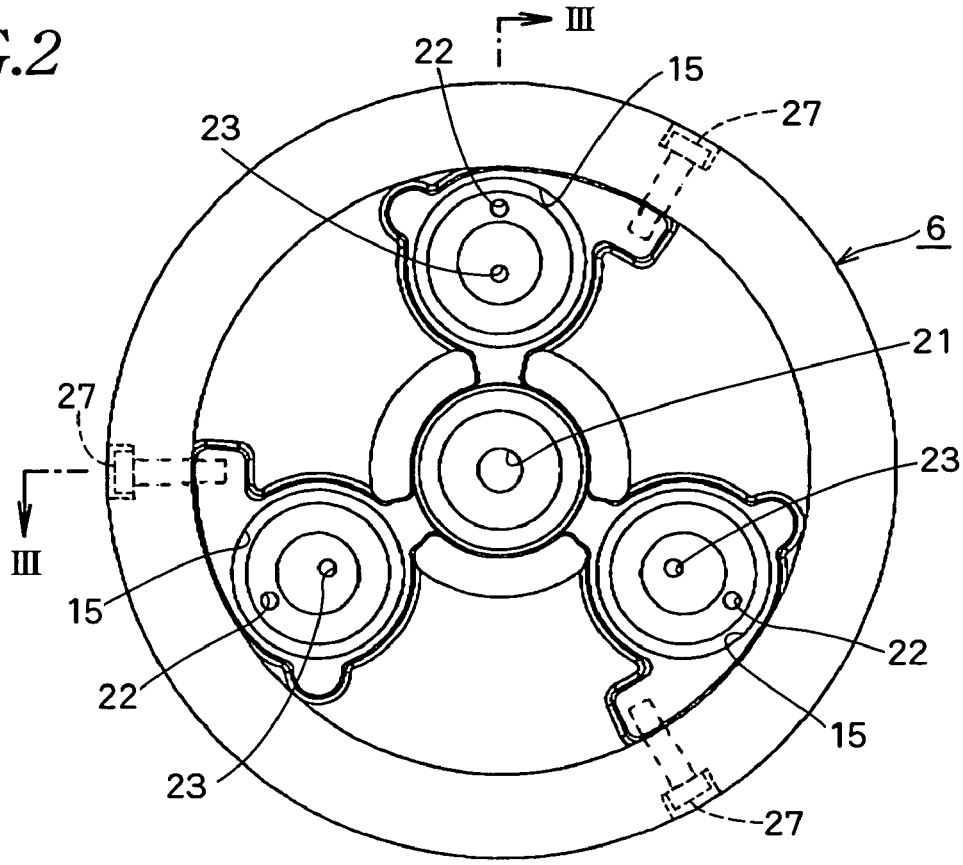
FIG. 2 is a vertical sectional view taken along the line II-II in FIG. 1.
Figure 3:
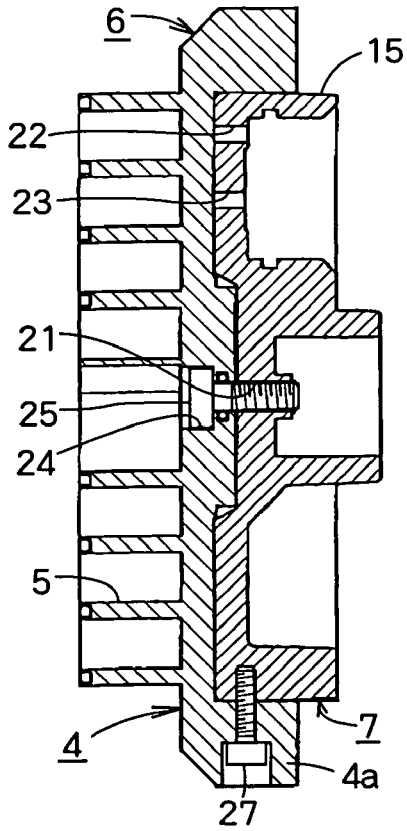
FIG. 3 is a sectional view taken along the line III-III in FIG. 2.

FIG. 1 is a vertical sectional side view of the first embodiment of a scroll fluid machine according to the present invention. FIG. 2 is a vertical sectional view taken along the line II-II in FIG. 1 in which a driving shaft and a self-rotation preventing device are removed. FIG. 3 is a sectional view taken along the line III-III in FIG. 2.

As shown in FIG. 1, the scroll fluid machine comprises a fixed scroll 3 which comprises a fixed end plate 1 having a spiral fixed wrap 2 on the rear surface, and an orbiting scroll 6 which comprises an orbiting end plate 4 having an orbiting wrap 5 on the front surface to allow the fixed wrap 2 to engage with the orbiting wrap 5.

The orbiting end plate 4 has a thick annular flange 4*a* and a reinforcement bearing plate 7 engaged in the annular flange 4*a* is placed on the rear surface of the orbiting end plate 4.

On the center of the rear surface of the reinforcement bearing plate 7, a bearing tube 11 projects to support an eccentric axial portion 9 of the driving shaft 8 rotatably via a needle bearing 10. The reinforcement bearing plate 7 has a tubular boss 15 for supporting the eccentric axial portion 9 of said driving shaft 8, and the tubular boss 15 has a central oil-supply bore 22, 23 to supply oil to the axial end portion 9 of the driving shaft 8.

At three points equally spaced on the rear surface of the reinforcement bearing plate 7, there is a tubular boss 15 which supports a follower 13 of a known pin-crank-type self-rotation preventing device 12 rotatably via a ball bearing 14.

A support 16 of the self-rotation preventing device 12 is rotatably supported in a housing 18 via a ball bearing 17. A through hole 20 is axially formed through a pin-crank 19 which connects the support 16 of the self-rotation preventing device 12 to the follower 13.

To coincide with the center of the eccentric axial portion 9 of the driving shaft 8, a female bore 21 is axially formed in the reinforcement bearing plate 7. To coincide with the ball bearing 14 of the follower 13 of the self-rotation preventing device 12, a follower-oil-supply hole 22 is axially formed, and to coincide with the through hole 20 of the pin-crank 19, a support-oil-supply hole 23 is formed.

Through a larger-diameter hole 24 at the center of the orbiting end plate 4, a bolt 25 is screwed into the female bore 21 so that the reinforcement bearing plate 7 is fixed exactly on the orbiting end plate 4.

On the rear surface of the housing 18, the support 16 of the self-rotation preventing device 12 is tightly covered with a cover plate 26 which prevents grease from going out of the ball bearing 17.

A plurality of bolts 27 such as three is radially put into the annular flange 4*a* of the orbiting end plate 4 to keep the reinforcement bearing plate 7 from rotation.

Figure 4:
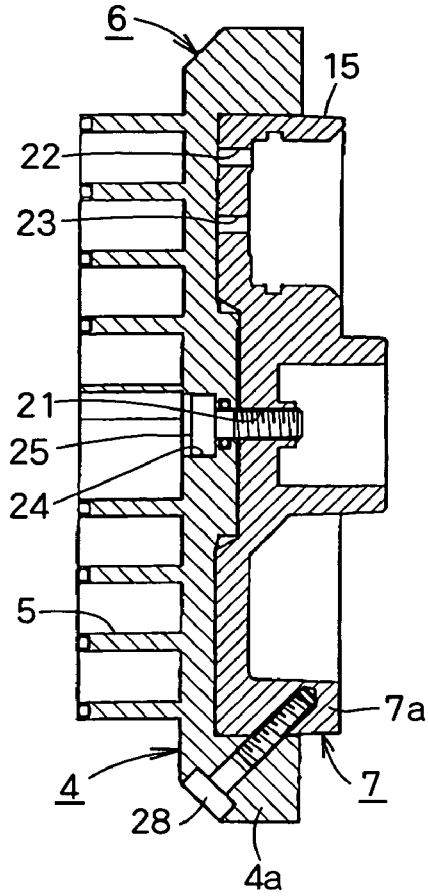
FIG. 4 shows the second embodiment of the present invention and is similar to FIG. 3.

FIG. 4 shows the second embodiment of the present invention and is similar to FIG. 3. The same numerals are allotted to the same members and only differences will be described.

An annular flange 7*a* of a reinforcement bearing plate 7 is fitted in an annular flange 4*a* circumferentially formed on an orbiting end plate 4. A bolt 28 is inserted from the outer corner of the front surface of the annular flange 4*a* inwards and rearwards and screwed in the annular flange 7*a* of the reinforcement bearing plate 7.

Figure 5:
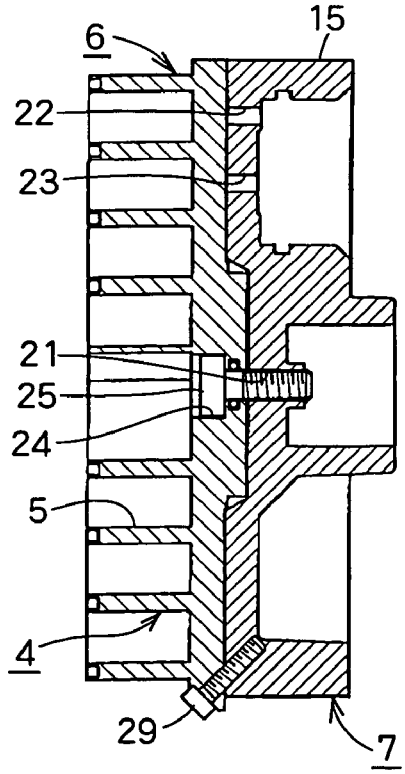
FIG. 5 shows the third embodiment of the present invention and is similar to FIG. 3.

FIG. 5 is the third embodiment of the present invention and similar to FIG. 3. The same numerals are allotted to the same members and differences are only described.

An orbiting end plate 4 having no annular flange is fitted on a reinforcement bearing plate 7 having no annular flange, and they are fixed to each other with a bolt 29 passing through the outer circumferences obliquely.

Figure 6:
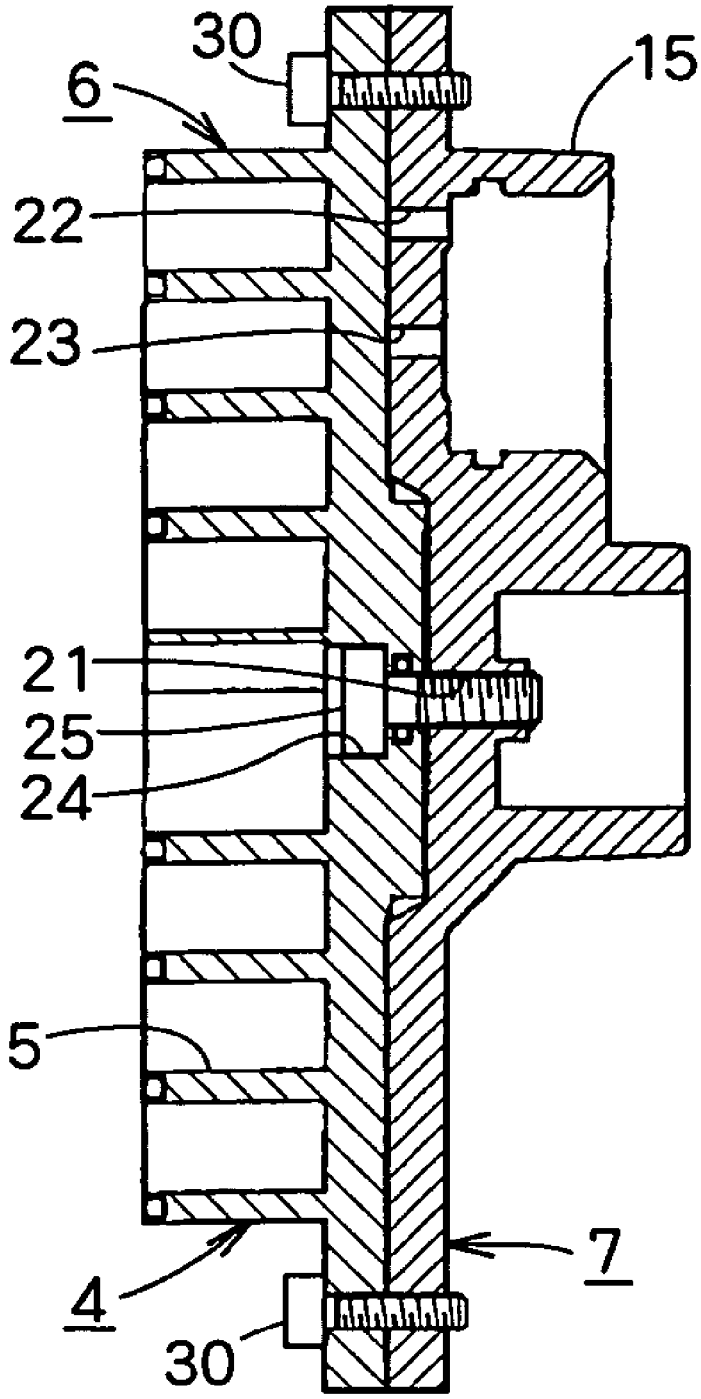
FIG. 6 shows the fourth embodiment of the present invention and is similar to FIG. 3.

FIG. 6 shows the fourth embodiment of the present invention and similar to FIG. 3. The same numerals are allotted to the same members and only differences will be described.

A bolt 30 passes through the outer circumferences of an orbiting end plate 4 and a reinforcement bearing plate 7 axially.

The foregoing merely relate to embodiments of the invention. Various changes and modifications may be made by a person skilled in the art without departing from the scope of claims wherein:

What is claimed is:

1. A scroll fluid machine comprising:

a housing;

a driving shaft having an eccentric axial portion at one end;

an orbiting scroll rotatably mounted around the eccentric axial portion of the driving shaft and comprising an orbiting end plate having an orbiting wrap on a front surface; and a fixed scroll fixed to the housing and comprising a fixed end plate having a fixed wrap;

a plurality of self-rotation preventing devices mounted on a rear surface of the orbiting end plate to prevent the orbiting scroll from rotating on its own axis, each of said plurality of self-rotation preventing devices comprising a support, and a support-oil-supply hole being formed through a reinforcement bearing plate to supply oil to the support; and the reinforcement bearing plate removably provided on the rear surface of the orbiting end plate and having a follower of each of said plurality of self-rotation preventing devices, and a follower-oil-supply hole being formed though the reinforcement bearing plate to supply oil to the follower.

2. The scroll fluid machine of claim 1 wherein each of said plurality of self-rotation preventing devices comprises a pin-crank connecting the follower to the support, said pin-crank having a through hole axially, said support-oil-supply hole communicating with the through hole.

3. The scroll fluid machine of claim 1 wherein said reinforcement bearing plate has a tubular boss for supporting the eccentric axial portion of said driving shaft, said tubular boss having a central oil-supply bore to supply oil to the axial end portion of the driving shaft.

4. The scroll fluid machine of claim 3 wherein a bolt is screwed in the central oil-supply bore as thread bore to fix the reinforcement bearing plate to the orbiting end plate.

5. The scroll fluid machine of claim 1 wherein said orbiting end plate has an annular flange extending rearward, said reinforcement bearing plate being engaged in the annular flange, a bolt being screwed radially towards an axis in the reinforcement bearing plate through the annular flange of the orbiting end plate to fix the orbiting end plate to the reinforcement bearing plate.

* * * * *